United States Patent [19]

Lucht et al.

[11] Patent Number: 4,463,253

[45] Date of Patent: Jul. 31, 1984

[54] TIME DISPERSION SENSOR TUBE

[75] Inventors: Hartmut Lucht; Carl-Wilhelm Mönch, both of Berlin, German Democratic Rep.

[73] Assignee: Akademie der Wissenschaftler der DDR, Berlin, German Democratic Rep.

[21] Appl. No.: 504,851

[22] Filed: Jun. 17, 1983

Related U.S. Application Data

[63] Continuation of Ser. No. 212,388, Dec. 30, 1980, abandoned.

[30] Foreign Application Priority Data

Dec. 13, 1979 [DD] German Democratic Rep. ... 217621
Jul. 9, 1980 [DD] German Democratic Rep. ... 222492

[51] Int. Cl.[3] ..... H01J 31/26

[52] U.S. Cl. ..... 250/213 VT; 313/537; 313/365

[58] Field of Search ..... 250/213 VT; 313/94, 313/99, 102, 381, 365, 523, 524, 537, 542, 373, 541

[56] References Cited

U.S. PATENT DOCUMENTS

| | | | |
|---|---|---|---|
| 3,973,117 | 8/1976 | Bradley | 313/381 X |
| 4,012,657 | 3/1977 | Loty | 250/213 VT X |
| 4,323,811 | 4/1982 | Garfield | 250/213 VT X |

*Primary Examiner*—David C. Nelms
*Assistant Examiner*—Edward P. Westin
*Attorney, Agent, or Firm*—Jordan and Hamburg

[57] ABSTRACT

A time dispersed sensor tube has a photocathode for receiving light images and converting them to photoelectrons. An anode adjacent the photocathode has a slit-diaphragm for accelerating photoelectrons and passing them to slit-jaws by way of a shutter electrode and counterelectrode. A deflection system is provided behind the slit-jaws for directing the photoelectrons to a screen. A short magnetic electron lens between the deflection system and the screen focuses the photoelectrons.

9 Claims, 1 Drawing Figure

TIME DISPERSION SENSOR TUBE

Figure 1:
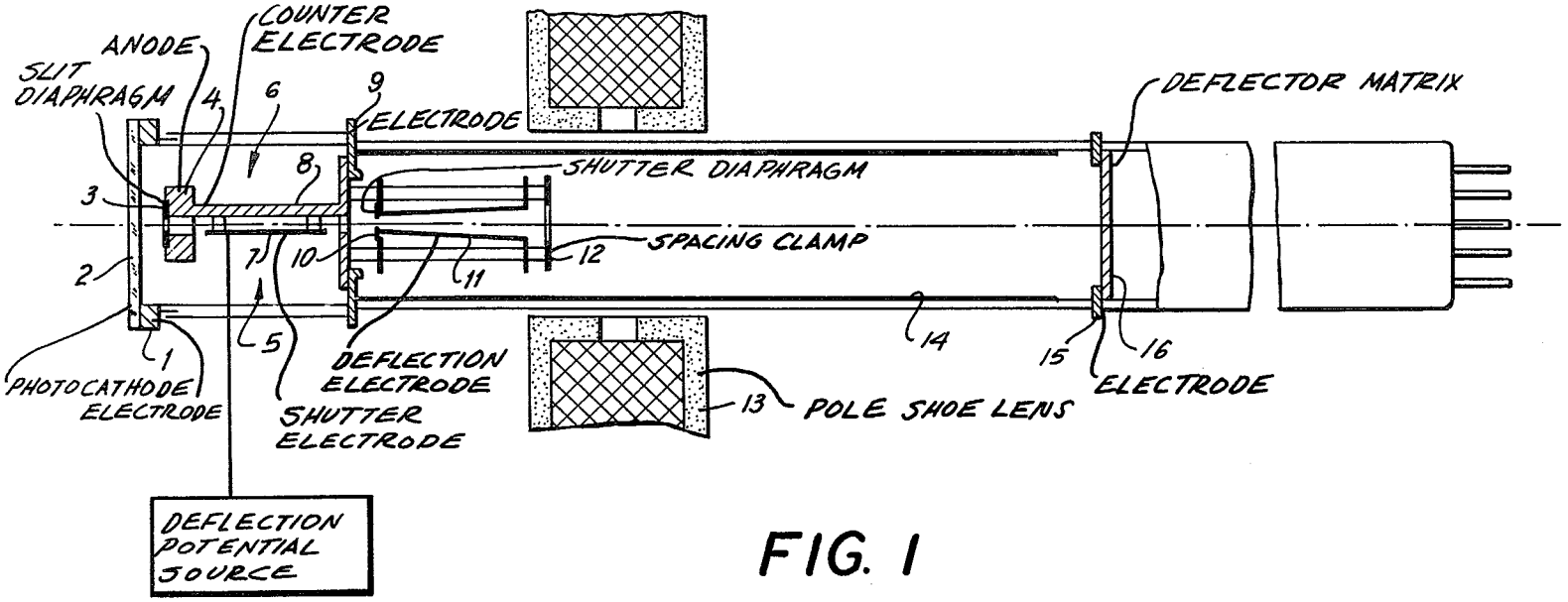
Figure 2:
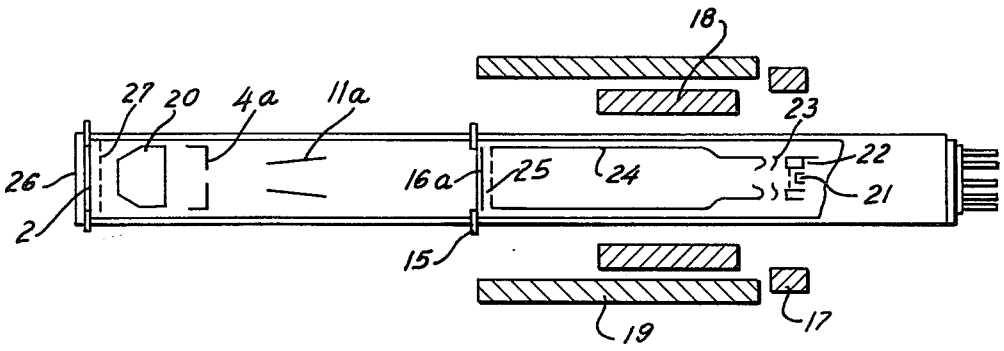

This application is a continuation of application Ser. No. 212,388, filed Dec. 30, 1980, now abandoned.

FIELD OF THE INVENTION

The invention relates to a time-dispersed sensor tube for the direct measurement of light-optical processes of short time duration and used particularly for instruments for measuring ultra-short light pulses, for instance ultra-short laser pulses, pulses of light fluorescence and light pulses of plasma discharges.

CHARACTERISTICS OF KNOWN TECHNICAL SOLUTIONS

U.S. Pat. No. 3,761,614 describes an electron optical picture tube for the measurement of picosecond light pulses where a narrow slit image produced at a photocathode is imaged upon a phosphor screen, whereby time-resolution is obtained by scanning with a deflection system. Progressive variation of brightness as a function of the time duration of the picosecond light pulse is observed on the phosphor screen of the tube along the scanning axis. In this electron optical picture tube an electrode, consisting of fine wiremesh is disposed immediately behind the photocathode. The purpose of this electrode is to produce a high field strength at the photocathode in order to keep variations of the transit times of the photo electrons small and in order to increase time dependent resolution. This electrode is followed by a focussing electrode, the anode with the anode aperture, the shutter, deflection electrodes and the phosphor screen. This construction has disadvantages. The accelerating mesh electrode has the tendency to reduce the resolution of the tube by adding a lens effect between adjacent meshes, where the sensitivity is reduced due to shading of the wires of the mesh electrode. The distance between the focussing electrode and the photocathode is considerably smaller than the distance to the screen so that the magnification of the image is always large. Thus large distances must be provided between the shutter electrodes and the deflection electrodes and large potentials are needed for their operation. Usual potentials are about 1000 V. The obtainable resolution of time is thereby reduced. In order to remove this disadvantage U.K. Patent specification No. 1 516 298 increases the distance between the accelerating electrode and the focussing electrode and thereby lowers the magnification of the image. In order to obtain a sufficient distance between deflection unit and screen the electron optical tube must be extended greatly and acquires thereby unwieldly proportions. Another disadvantage of imaging by an electrical focussing electrode is that the plane of the image is curved and that thereby a small area of sufficiently sharp image appears upon the plane image screen. The shutter of the electron optical image tube serves to interrupt the measuring process and usually consists of two shutter electrodes of a slit diaphragm and two compensation electrodes. In order to interrupt the measuring process the electron beam must be deflected upon a slit-jaw of the slit diaphragm by applying an electrical potential to the shutter electrodes.

This deflection process is reproduced upon the screen at its beginning and leads to wrong measuring results. By simultaneous application of the deflection potential to the compensation electrodes in opposite direction the first deviation of the electronbeam is nullified and the focus lies at the same place in the image plane when the measurement is interrupted. The sutter is expensive to manufacture.

The image appearing upon the phosphor screen may be photographed with a photographic or Vidicon camera. The radiant power gain is usually between 1 and 40 mm, depending upon the material of the photocathode and the phosphor at an anode potential of 10 kV. The radiant power gain is defined as the quotient of the total output power from the fluoroscent screen and the incident radiant power at the specified wavelength of maximum response of the spectral sensitivity. When the picture of the phosphor screen is imaged on the photographic film or by the Vidicon some light is lost lowering the radiant power output and the sensitivity gain.

Furthermore processes for measuring light-optical processes in the ps-range are known which use non-linear optical methods. For example, a two-photon-fluorescence may be produced making use of the intensity-autocorrelation, or the second harmonic oscillations of the laser pulses may be produced and the autocorrelation method may be also used for measuring the duration of the pulse. Disadvantages of this method are that the images produced do not unequivocally reproduce the shape of pulse of the laser pulse and that pulses of lower intensity cannot be measured. These processes are generally unsuitable for measuring fluorescence.

OBJECTIVE OF THE INVENTION

The object of the invention is to attain the highest transient and one dimensional pictorial resolution with higher light sensitivity and less expense than up to now.

EXPLANATION OF THE INVENTION

The object of the invention is the provision of a time-dispersed sensor tube which makes possible the creation of a narrow-slit image upon the photocathode by electron optical means and of high quality upon a screen, while eschewing high production potentials for the unit of deflection and shutter electrodes as well as electrical focussing and without using a grating having shadowing and defocussing properties. Another objective is the measurement of low light intensities without intercalation of a micro-channel-plate.

The object is fulfilled by providing a time-dispersed sensor tube for measuring short-lived light optical processes with a photocathode, an anode, a shutter, a deflection system focussing optic and a screen. Here the anode with an anode-slit diaphragm is arranged immediately behind the photocathode and the anode is simultaneously the counter electrode for a shutter electrode, whereby they enclose the electron beam traversing the anode and a shutter diaphragm, a deflection system, a short magnetic lens follow in the direction of the beam and the screen. Preferably the time dispersed sensor tube is shaped in such a way, that the distance between photo-cathode and anode amounts to a few millimeters and the slit width of the anode slit diaphragm amounts to 0.1 mm, that the shutter electrode and the counter electrode are arranged relative to each other so that the distance from one to the other lies in the range of 1 mm that the distance of the deflection plates in the direction of the beam rises from 1 mm to several mm and that the width of the shutter diaphragm lies between a few tenths of a mm and one millimeter. The short magnetic lens may be a pole-shoe lens and may be disposed immediately behind the deflection electrodes, in which case the distance between deflection electrodes and main plane of the lens is preferably one to four times as large as full width of half maximum of the magnetic field distribution. The slit-jaws of the shutter diaphragm may be arranged at the entrance of the deflection electrodes. The anode and counter electrode, especially may be a single turned part formed with recesses.

In that case tha plane of one recess which lies opposite the shutter electrode encloses together with the shutter electrode symmetrically the symmetry axis of the turned part. The recesses of the turned part may be produced by milling.

The time-dispersed sensor tube may be constructed so that the anode has a bias for electron energy of 10 kV and more. Here the deflecting electrodes which direct the electron beam perpendicular to the orientation of the slit are arranged parallel to the slit, and a semiconductor detector matrix for detection of accelerated and deflected photo electrons is disposed behind the focussing optic. The detector matrix may be the silicon diode matrix of a Vidicon, in which case the Vidicon is disposed additionally inside the tube. Starting at the photocathode photoelectrons of an image strip of small height are drawn off by accelerating anode and accelerated to high energy.

After deflection and focussing, the photoelectrons are directed towards the rearside of the detector matrix where the accelerated and deflected photoelectrons produce charge carrier pairs. That causes changes of charge in the individual detectors and these changes of charge may be scanned by the electron beam of a Vidicon upon the anterior side of the semiconductor detector matrix.

The width of slit of the first accelerating electrode or anode may preferably lie in the range of the row height of the semiconductor matrix. The detectors are arranged upon the semiconductor matrix in rows and columns. Deflection occurs perpendicular to the rows, so that the width of the slit image, the height of the scanned rows, the speed of deflection, the magnification and the error of imaging of the electron-optical system are the determinants for the obtainable resolution of time. The width of the slit image and the diameter of focus of the electron beam, scanning the semiconductor detector matrix lie in the range of height of the scanning rows of the detector matrix. The resolution within the scanned line is determined by the breadth of the arrays of the semiconductor detector matrix and by the image errors of the electron optical system. Conventional diode matrixes possess about 500 rows and columns. A deflection of one nanosecond for 500 rows is capable of resolving times of a few picoseconds. The system of scanning the semiconductor diode matrix from the anterior or planar side corresponds to the system of a Vidicon.

Photocathodes consist of conventional materials such as combinations Na-K-Cs-Sb and Na-K-Sb for the ultraviolet and the visible region and Ag-O-Cs for the visible and the infrared regions.

The electrons, accelerated by the electrical field of the anode strike the uncoated blank rearside of the semiconductor detector matrix which consists preferably of silicon and produce about 300 charge carrier pairs per 1 keV energy. That applies for energies between 5 and 10 keV and occurs within a volume of the silicon diode matrix, which extends to a depth of approximately 1000 nm under the surface of the rear. An appreciable part of the charge carrier pairs recombines at the surface of the semiconductor wafer. A drift field built into the rearside of the diode matrix by doping with impurity atoms allows a lowering of the recombination process so that about 200 to 300 charge carrier pairs become effective as a signal. Radiation damages do not occur as long as the energies of the electrons do not surpass 1 MeV. Furthermore the time-dispersed sensor tube may be built in such a manner that the deflection system is disposed in the sensor tube in front of an integrated semiconductor detector matrix of diodes or MIS-capacitors and that the semiconductor detector matrix may be scanned directly electrically in series or random access as to its charge situation. The accelerated and deflected photoelectrons strike the unstructured and uncoated rearside of the semiconductor detector matrix, form within the semiconductor volume charge carrier pairs and causes charge changes within the diodes or MIS-capacitances. The time-disperse sensor tube permits the production of the time-dispersion as well as a unidimensional image resolution in a tube with high light sensitivity, so that even single photons are recorded.

Due to the high energy of the electrons in the deflection unit the transit time dispersion of the electrons and the transit time within the deflection plates are kept small and thereby a favorable time resolution is obtained.

The invention will now be explained in greater detail with respect to the accompanying drawing, wherein:

FIG. 1 shows a section through time dispersion sensor tube.

It shows an image strip a few tenths of a millimeter in height and a few millimeters wide across a window on a Na-K- Cs-Sb-photocathode 2, which has a 10 kV bias. Terminal 1 supplies the bias.

Anode 4 with the anode slit diaphragm 3 is disposed 5 mm behind the Na-K-Cs-Sb photocathode 2. The width of the anode slit diaphragm 3 is 0.1 mm wide. The anode 4 is a turned part which is milled to provide the recesses 5 and 6. It provides the counter electrode 8 for the shutter electrode 7. The shutter of first deflection electrode 7 is fastened to the recessed turned part by glass or ceramic spacers and is supplied with its potential by way of a not shown glass duct.

The anode 4 and the counter electrode 8 are supplied with bias of 0 V by electrode 9. Electrodes 8 and 7 are 1.4 mm apart. When a deflection potential of about 100 V is fed to the shutter electrode 7, the electron beam arriving through slit 3 is deflected towards the lower slit-jaw of the shutter diaphragm 10. The gap is 0.5 mm wide. Both slit-jaws are fastened directly to both deflection electrodes 11. The distance between the deflection plates increases from 1 mm to 4 mm in the direction of travel of the electron beam. The deflection plates are fastened to the turned part by glass or ceramic spacers and the spacing clamp 12. Electrical supply for the deflection electrode 11 occurs through (not shown) glass ducts and deflection potentials of about 100 V are needed. Within the tube is disposed an evaporated metal layer 14, which also is fed with the potential 0 V by means of electrode 9.

The electron beam, deflected by the deflection plates is focussed on the electron sensitive semiconductor detector matrix 16 with the supply electrode 15 by a pole shoe lens 13, disposed immediately behind the deflection unit. The detector matrix provides, as described in the second example, an image of the time pattern of the intensity distribution of the image strip upon the photocathode.

The matrix is scanned from top to bottom in time sequence by control of the potential at the deflection plates 11 *a*. The charge carrier pairs, produced within the diode matrix by the accelerated electrons discharge the diode capacities, charged by an electron beam upon the front or planar side of the matrix. Thus the discharging state is at any instant proportional to the electron stream, arriving at the rear and therefore to the strength of illumination at the photocathode 2. Renewed charging of the diode capacitances by the electron beam at the front side or the planar side of the matrix simultaneously responds to the state of discharge, which is received as a current signal at the electrode 15.

Interferring electrons produced at the photocathode by thermal emission are below 100 electrons per second at room temperature for the cathode used and with an active surface of one square millimeter. The dark current of the photocathode may therefore be neglected for the measuring of fast running processes. An electron of 10 keV causes a change of charge of the diode capacitor of about $3 \cdot 16^{16}$ ampere second. That equals ten times the change of charge created by the dark current of the diode at room temperature in the scanning time of 32 msec. Changes of charge, caused by single photoelectrons, thus cause charge changes lying considerably above the background of the diode.

The scanning time and thus the integrating time of the diodes cannot be extended above 0.2 sec at room temperature because after that already considerable quenching of the stored charge occurs due to the dark current. For lowering of the dark current in silicon the rule is valid that each cooling of 25° C. lowers the dark current by a factor of 10. Thus the time of integration may last already several minutes when the silicon diode matrix is cooled. That makes it possible to repeat measurements at low intensities several times during the time of integration and thereby to improve considerably the signal to noise ratio.

The advantage of the time dispersed sensor tube of the invention is, that the potentials needed for switching and deflecting the electron stream beam are smaller by about one order of magnitude.

No grid with shadowing and defocussing properties is needed for the acceleration of the electrons. The narrow guidance of the electron stream beam and the great field strength at the photocathode minimize fluctuations of the transit times of the photoelectrons.

The magnetic pole shoe lens possesses a considerably less curved image plane than the conventional electrical lenses so that greater resolution is obtained and plane screens may be used. Furthermore the definition of depth is increased due to the small relative aperture of the electron beam.

An additional advantage is that the time-dispersed sensor tube permits the desired increased amplification to be obtained by suitable positioning and suitable operation of the magnetic lens.

We claim:

1. A time dispersed sensor tube comprising a photocathode for receiving light images which may be in the picosecond range and converting them to photoelectrons, an anode immediately adjacent said photocathode and having a slit diaphragm for accelerating photoelectrons away from said photocathode and for passing said photoelectrons therethrough, a shutter electrode and a counter electrode in the path of said photoelectrons beyond said anode, slit jaws defining a shutter diaphragm beyond said shutter electrode and said counter electrode whereby said photoelectrons impinge on said slit jaws when said shutter electrode is connected to a deflection potential for shutting said tube, a deflection system beyond said slit jaws for deflecting said photoelectrons, a screen positioned to receive and detect said photoelectrons from said deflection system, for providing a strip image, and a short magnetic electron lens mounted between said deflection system and said screen and immediately adjacent said deflection system for focusing said photoelectrons.

2. The time dispersed sensor tube of claim 1 wherein said anode and said counter electrode consist of a single turned part formed with recesses, wherein the plane of one recess lies opposite the symmetry axis of the turned part from the shutter electrode and defines the counter electrode, the counter electrode and the shutter electrode enclosing and being symmetrically spaced from the electron beam at a distance of the order of 1 millimeter.

3. The time dispersed sensor tube of claim 1 wherein said anode is spaced a few millimeters from said photocathode and the slit width of said anode slit diaphragm amounts to 0.1 millimeter.

4. The time dispersed sensor tube of claim 1 wherein the distance between the plates of said deflection system increases from 1 millimeter to several millimeters in the direction of travel of the electron beam.

5. The time dispersed sensor tube of claim 1 wherein said short magnetic lens comprises a pole shoe lens.

6. The time dispersed sensor tube of claim 1 wherein said screen for receiving and detecting said photoelectrons comprises a semiconductor detector matrix detecting the accelerated photoelectrons.

7. The time dispersed sensor tube of claim 6 wherein said semiconductor detector matrix comprises the silicon diode matrix of a Vidicon.

8. The time dispersed sensor tube of claim 6 wherein said semiconductor detector matrix comprises an integrated matrix of semiconductor diodes wherein said matrix of diodes may be scanned directly electrically in series or random access and arranged to receive said photoelectrons.

9. The time dispersed sensor tube of claim 6 wherein said semiconductor detector matrix comprises an integrated matrix of metal-insulator-semiconductor capacitors wherein said matrix of capacitors may be scanned directly electrically in series or random access.

* * * * *